US005624082A

United States Patent [19]

Ligon

[11] Patent Number: 5,624,082

[45] Date of Patent: Apr. 29, 1997

[54] IN-LINE YARN FEED CREEL

[76] Inventor: Lang S. Ligon, P.O. Box 5578, Station B, Greenville, S.C. 29606

[21] Appl. No.: 526,405

[22] Filed: Sep. 11, 1995

[51] Int. Cl.[6] ..... B65H 49/02; D03D 47/34

[52] U.S. Cl. ..... 242/131; 139/450

[58] Field of Search ..... 242/130, 131, 242/131.1; 139/450

[56] References Cited

U.S. PATENT DOCUMENTS

| | | | |
|---|---|---|---|
| 1,818,223 | 8/1931 | Jordan | 242/130 |
| 2,571,523 | 10/1951 | Bennett | 242/131 |
| 3,169,248 | 2/1965 | Cont | 139/450 |
| 3,236,265 | 2/1966 | Brookshire | 139/122 |
| 3,428,188 | 2/1969 | Boudreau et al. | 242/131 X |
| 3,693,904 | 9/1972 | Bucher | 242/131 |
| 3,915,406 | 10/1975 | Rolli et al. | 242/131 |
| 4,358,068 | 11/1982 | Weiss | 242/131 |
| 4,450,876 | 5/1984 | van Mullekom | 139/435 |
| 4,540,138 | 9/1985 | Gutschmit | 242/131 |
| 4,545,547 | 10/1985 | Singer | 242/131 |
| 4,648,564 | 3/1987 | Wright, Jr. | 242/130 |
| 4,728,055 | 3/1988 | Wright, Jr. et al. | 242/131 X |
| 5,107,904 | 4/1992 | Van Mullekom | 242/131 X |
| 5,314,139 | 5/1994 | Mori | 139/450 X |

*Primary Examiner*—Michael R. Mansen
*Attorney, Agent, or Firm*—Cort Flint

[57] ABSTRACT

An adjustable yarn creel frame for feeding yarn to an associated textile machine in a generally in-line yarn delivery path and a rear frame section; and at least one creel unit carried. The creel frame includes a plurality of creel units each having a yarn eyelet near the front frame section. A first pair of generally level yarn package holders is carried by creel in position for the yarn packages mounted thereon to have a center line extending towards the yarn eyelet. A second pair of inclined yarn package holders is carried by the frame in a vertically spaced position relative the first pair of yarn package holders but with their center line extending towards the yarn eyelet. Adjustable frame elements connect front and rear frame sections to vary a horizontal distance between the yarn eyelet and yarn package holders.

19 Claims, 4 Drawing Sheets

IN-LINE YARN FEED CREEL

BACKGROUND OF THE INVENTION

This invention relates to feeding of yarn to textile machinery and processes, and in particular, to an improved yarn creel which feeds weft yarn from yarn packages to an associated yarn accumulator and/or loom and accommodates an increased number of yarn packages while providing a relatively straight in-line yarn delivery path in which yarn bends and changes in direction are minimized.

Yarn creels are known in the art which support yarn packages upon which yarn is wound for delivery to an associated textile machine such as a loom. The previous yarn creels have been provided in various horizontal and vertical arrangements. For example, U.S. Pat. Nos. 3,693,904 and 4,450,876 disclose a horizontal arrangement of yarn packages arranged in pairs for supplying an associated loom. U.S. Pat. Nos. 3,236,265; 4,358,068; and 4,648,564 disclose vertical arrangements of yarn packages arranged in pairs for feeding associated textile machinery such as looms. By tying the two packages together, an empty package may be replaced with a full package while the remaining package feeds the loom. In this manner, a rather continuous feed of yarn is provided.

With the advent of higher speed looms, the arrangement of two yarn packages tied together has become increasingly insufficient to supply the loom, and creels with arrangements of four yarn packages tied together have been provided. For example, U.S. Pat. No. 4,545,547 discloses a creel commonly known as a "carousel" creel which includes four yarn packages arranged horizontally and tied together. However, in this type of creel, the yarn must undergo several changes in direction as it is fed from the horizontal yarn packages to the loom, or other associated machinery such as a yarn accumulator. Each time that the yarn changes its direction, particularly sharply, the chances of a yarn break are greatly increased because of the increased tension resulting from increased angles. Yarn breaks cause interruption in the textile process or machinery. Yarn breaks also result in defects in fabric being woven on a loom. Modern high speed looms feed yarn up to 1800 meters per minute. The size of the yarn packages which can be provided and supported on a creel, and hence amount of yarn, is limited due to practicalities such as weight and space occupied by the package. Typically, yarn packages of up to 12" in diameter are utilized. Accordingly, the provision of creels holding large number of yarn packages for feeding yarn to high speed looms so that the changes in direction of the yarn are minimized during yarn delivery is a problem to which considerable attention may be given.

Accordingly, an object of the present invention is to provide an improved yarn creel for feeding yarn at high speeds with a minimum of yarn breakage.

Another object of the invention is to provide an improved yarn creel for feeding yarn at high speeds from multiple packages wherein the bends occurring in the delivery path of yarn are minimized.

Another object of the invention is to provide a yarn creel for supporting multiple, large packages of yarn in a vertical arrangement which delivers the yarn in a path which is generally in-line with the yarn accumulator and/or loom to which the yarn is fed so that the bends in the yarn delivery path are minimized.

Another object of the present invention is to provide a highly versatile yarn creel having an in-line yarn delivery path to associated textile machinery which can be easily reconfigured to feed from one to four colors of yarn to an associated textile machine.

SUMMARY OF THE INVENTION

The above objectives are accomplished according to the present invention by providing a yarn creel for feeding yarn to an associated textile machine having a generally in-line yarn delivery path. The yarn creel comprises at least one creel unit having a creel frame with a front frame section and a rear frame section. The creel unit comprises a first pair of yarn package holders carried by the frame in a laterally spaced relation. A second pair of yarn package holders is carried by the frame in a laterally spaced relation, and vertically spaced from the first pair of yarn package holders. A yarn eyelet is carried by the frame by the front frame section. A first pair of yarn package holders are disposed so that the first pair of yarn packages mounted on the yarn package holders have a center line which extends towards the yarn eyelet. A second pair of yarn package holders is inclined upward so that the second pair of yarn packages mounted on the yarn package holders have a center line which extends towards the yarn eyelet. The first and second pairs of yarn package holders are positioned and arranged to mount four yarn packages tailed together to feed yarn to a single associated textile machine generally in-line with the machine with reduced bends in the yarn delivery path. Two of the creel units may be made integral with the creel frame either in a vertical arrangement as in the illustrated embodiment, or side-by-side to provide a weft yarn supply for most modern high speed looms.

Advantageously, the first and second pairs of yarn holders are carried by the rear frame section in a vertical plane, and the yarn eyelet is carried by the front frame section. The creel frame includes adjustable frame elements connected between the front and rear frame sections allowing the yarn eyelet and yarn package holders to be adjusted with respect to their horizontal spacing to provide for adjustable tensioning of yarn being fed from yarn packages mounted on the yarn package holders. In the illustrated embodiment, the adjustable frame elements comprise a first telescoping frame element carried near a bottom of the creel frame, and an upper telescoping frame element carried near an upper portion of the creel frame. The upper and lower frame elements comprise telescoping legs and a lock which locks the telescoping legs in a desired position wherein the front and rear frame sections are spaced a desired distance apart.

The first pair of yarn package holders includes the first and second yarn package holders, and the second pair of yarn package holders include third and fourth yarn package holders which are upwardly inclined. In another advantageous feature of the invention, lower adjustable mounts carry the third and fourth yarn package holders. A third pair of yarn package holders, which include fifth and sixth yarn package holders, is also carried by the lower adjustable mounts in a generally level configuration and spaced about 180 degrees from the inclined, second pair of yarn package holders. The third pair of yarn package holders may be rotated 180 degrees into a feeding position, and a second yarn eyelet may be added to receive yarn from the third pair of yarn package holders. Each creel unit may be advantageously converted into feeding two tailed yarn packages from the level first and third pair of yarn package holders.

A method of the invention includes feeding weft yarn to an associated textile machine in a yarn delivery path which is generally in-line and comprises the step of mounting a first pair of yarn packages consisting of a first yarn package and a second yarn package in a horizontally spaced apart manner. The first and second yarn packages are arranged so that the center lines of the yarn packages extend to a yarn eyelet. Next, a second pair of yarn packages consisting of third and fourth yarn packages are mounted vertically below the first and second yarn packages. The third and fourth yarn packages are mounted at an inclination so that their center lines extend to the yarn eyelet. The tail ends of the yarn packages are secured together so that yarn delivered through the yarn eyelet is supplied sequentially from the four yarn packages to the associated textile machine. The horizontal distance between the yarn packages and the eyelet is adjusted to provide a desired tension to the yarn being delivered off of the yarn packages. Preferably, the third and fourth inclined yarn packages are carried on rotatable mounts which also carry a pair of generally level yarn package holders. The method then contemplates selecting the inclined or level yarn package holder depending on whether four yarn packages are to supplied together, or two yarn packages are being supplied together, and providing an additional yarn eyelet when the creel is converted to feeding two yarn packages together.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
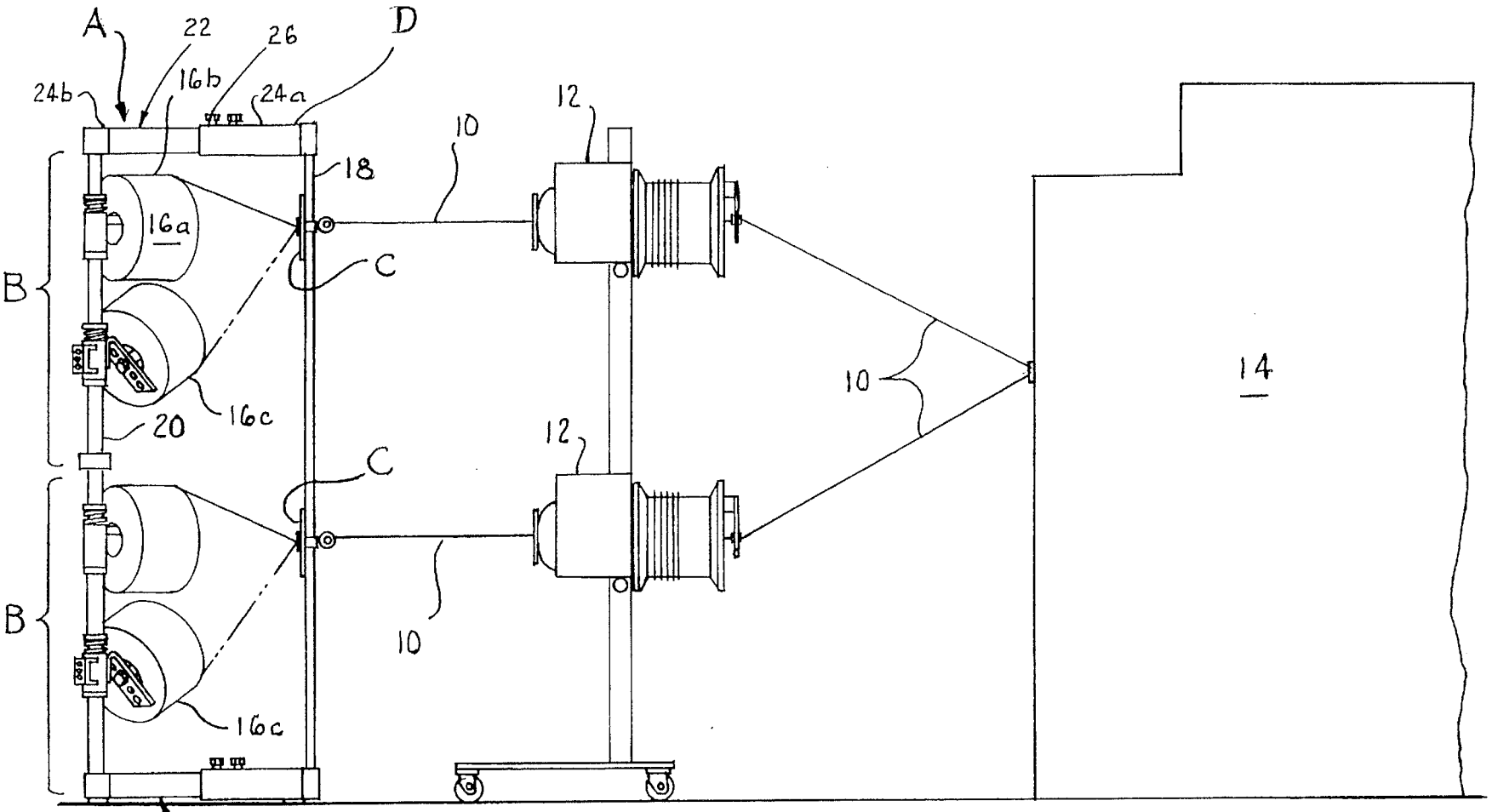
FIG. 1 is a side elevation illustrating a yarn creel constructed according to the invention having an in-line yarn delivery path to a loom.

As can best be seen in FIG. 1, a yarn creel, designated generally as A, is illustrated for feeding weft yarn 10 to either yarn accumulators 12, or directly to a loom 14. In the preferred embodiment, creel A includes a pair of creel units B each of which accommodates a supply of weft yarn in the form of four weft yarn packages 16*a*–16*d*, as can best be seen in FIG. 2. Weft yarn 10 from each creel unit B is fed through a yarn eyelet assembly C. The four yarn packages may be tailed together at 17 (FIGS. 2 and 4).

Figure 4:
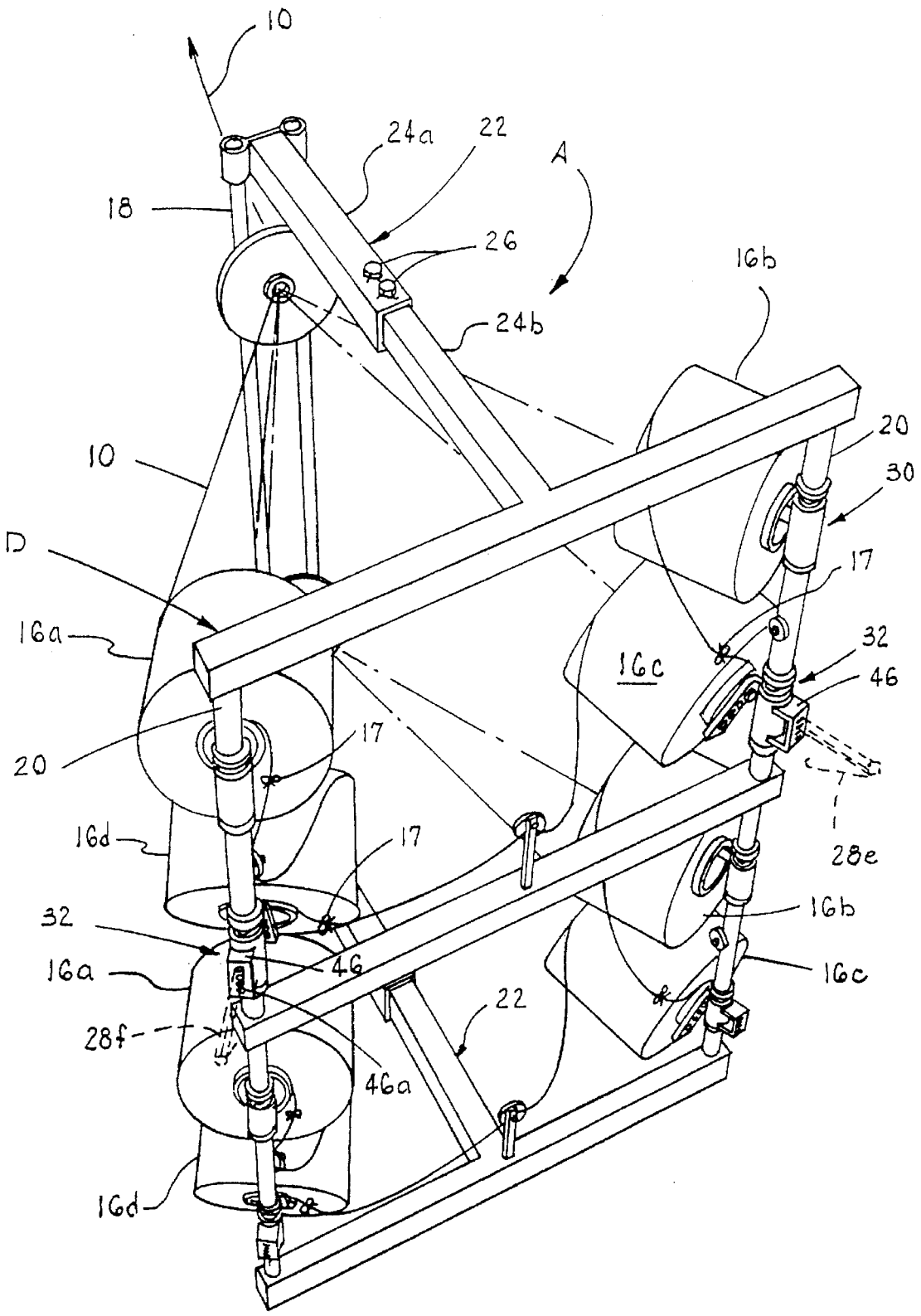
FIG. 4 is a rear perspective view of a yarn creel according to the invention having two vertically stacked creel units each of which may be configured to feed multiple yarn packages to a single textile machine either as two tailed packages or four tailed packages.

Creel units B are illustrated as carried by a unitary creel frame, designated generally as D, which includes a front frame section 18 and rear frame section 20 joined together by an adjustable upper and lower frame element 22 so that the distance between the front and back frame section may be adjusted and varied, as can best be seen in FIGS. 1 and 4. By this means, the distance between yarn eyelet assembly C and yarn packages 16*a–d* may be adjusted to vary the tension on the yarn. The distance between the yarn eyelet assembly and the yarn packages generally affects the tension on the yarn. Therefore to realize optimum tension control, this adjustment is desirable. For this purpose, horizontal frame elements 22 may include a first leg 24*a* which telescopically receives a second leg 24*b*. A locking section includes set screws 26 which lock the second leg 24*b* in a telescoping position within first leg 24*a* to adjust the distance between the yarn eyelet assembly and yarn packages, i.e. adjust the distance between the front and rear frame sections.

While the preferred embodiment is illustrated as two vertically stacked creel units, it is to be understood that creel units B may also be provided in the form where they are arranged side-by-side, depending on the requirement of the supplied. In addition, one or more of the creel units may be utilized also depending on the application being made.

Figure 2:
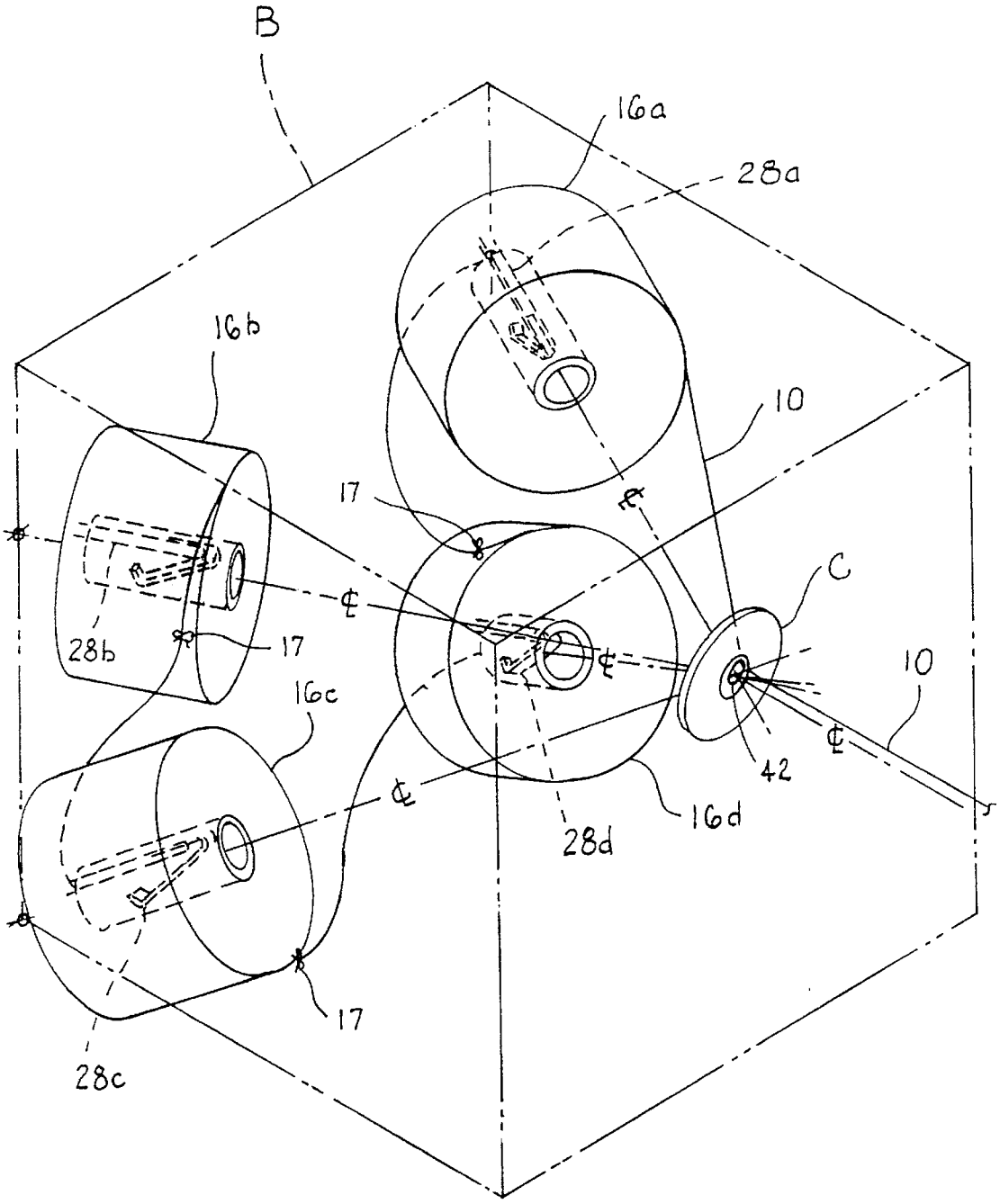
FIG. 2 is a perspective view illustrating four yarn packages arranged in a vertical plane which are tied together for feeding yarn to a single yarn accumulator or loom in accordance with the present invention.
Figure 3:
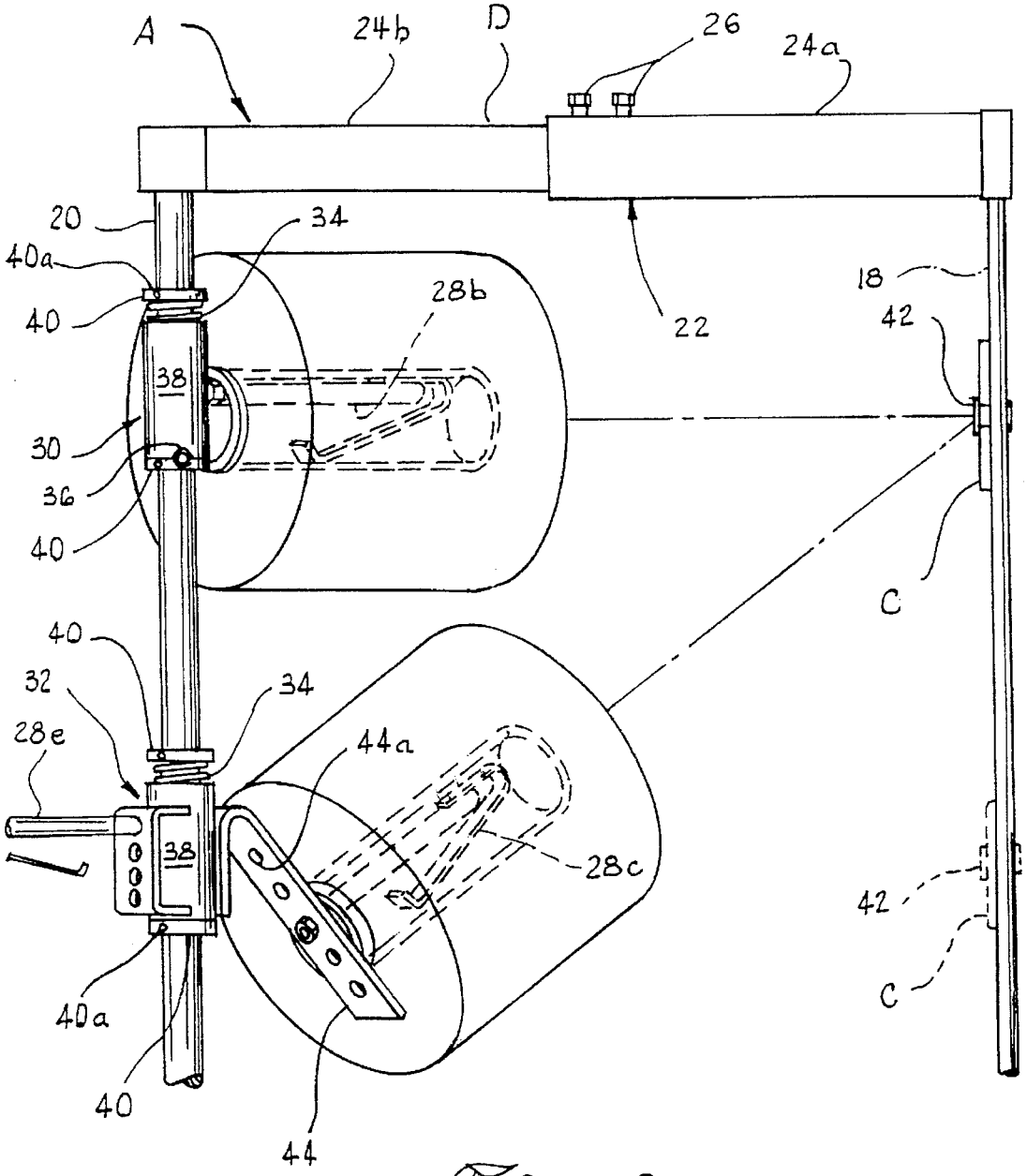
FIG. 3 is an enlarged side elevation illustrating a creel unit according to the invention for use on a creel wherein four yarn packages are vertically arranged for feeding yarn generally in-line to an associated textile machine.

As can best be seen in FIGS. 2 and 3, upper yarn packages 16*a* and 16*b* are carried on upper yarn package holders 28*a* and 28*b*, and lower yarn packages 16*c* and 16*d* are carried on yarn package holders 28*c* and 28*d*. Yarn package holders 28*a, b, c*, and *d* may be any suitable yarn holder such as shown in U.S. Pat. No. 4,728,055. The upper yarn package holders 28*a* and 28*b* are carried on upper adjustable mounts 30. Lower yarn package holders 28*c* and 28*d* are carried on lower adjustable mounts 32. Each adjustable mount comprises a spring 34 and a ball/detent lock 36 formed in a slidable collar 38. By urging collar 38 upward along frame 20 against spring 34, lock 36 is released so that the yarn package holder may be rotated rearwardly to exchange an empty package for a full package. Collars 38 are positioned on the frame 20 by means of positioning collars 40 which sandwich collar 38, and are fixed in place by set screws 40*a*.

Referring now in more detail, it can be seen that upper yarn package holders 28*a*, 28*b* are carried by upper adjustable mounts 30 in a generally level condition. The package holders carry the yarn packages 16*a, b* so that the center line of the yarn package passes through a ceramic eye 42 of yarn eyelet assembly C. In contract, slidable collar 38 carries lower package holders 28*c*, 28*d* by means of an angle bracket 44 which is connected therewith. Angle bracket 44 includes a plurality of hole mounts 44*a* so that the lower package holders 28*c, d* may be adjustably positioned on the bracket. Angle bracket 44 may be provided in a form in which the angle of the bracket is adjustable. In this manner, the package holders may be adjusted to hold lower yarn packages so that the center line of the yarn packages also passes through the ceramic eye 42. The yarn package holders and yarn packages may also be adjusted as desired to provide the desired alignment by moving the positioning collars 40 vertically on frame 20 (FIG. 3) in a conventional manner. The positioning collars are unlocked for adjustment and locked for retaining the holder and package in the desired position by means of set screws 40*a*.

Lower adjustable mount 32 differs mainly from upper adjustable mount 30 in that a second, cantilever yarn package holder 28*e* is carried on the back side of each collar 38 spaced 180° from holders 28*c*, 28*d*. This allows the creel of the present invention to be reconfigured to provides more versatility. For example, in the illustrated embodiment, upper creel unit B includes four yarn packages tied together to feed a single accumulator 12 or a loom 14, directly. Lower creel unit B also feeds four yarn packages 16*a, b, c, d* to a lower accumulator 12, or directly to loom 14. This allows for supplying either the same color or two colors to the loom. In order to be able to supply three or four colors to the loom, the creel of the present invention may be advantageously reconfigured by rotating lower mounts 32 180° to position holders 28*e* and 28*f* so that each creel unit supports two level yarn packages. Two additional yarn eyelet assemblies C may then be attached to front frame section 18 to feed yarn in-line from the lower yarn packages of each creel unit B (FIG. 3). When configured in this manner, the pairs of yarn packages which are positioned side-by-side will be tailed together. This means there will be four pairs of yarn packages vertically spaced along the height of creel A. Each pair of packages will be tailed and will be fed in-line through the four vertically spaced yarn eyelets 42. In this manner, four colors of yarn may be fed to the loom, as well as other variations. The creel may be easily configured to supply from one to four colors merely by a rotation of the lower yarn package holders and the addition of two eyelets. For alignment purposes, yarn package holders 28*e* and 28*f* are mounted to a rear bracket 46 having a plurality of holes 46*a* to allow for vertical positioning of holders 28*e*, 28*f*. In this manner, additional adjustment of the yarn package holder may be had.

In use, a highly versatile creel is provided which may accommodate the feeding of weak yarns as well as strong yarns. In the case of weak yarns, it is often desirable to provide that the yarn eyelet assembly C is positioned close to the yarn package. As explained above, this may be done by moving the front frame section toward the back frame section. The eyelet will move directly along the center line toward the upper yarn packages 16*a*, 16*b*. It will only be necessary to adjust the lower yarn packages 16*c*, 16*d* in each creel unit. The adjustment of the lower yarn packages may be had by raising and lowering the adjustable lower mounts 32 as well as moving the yarn holders 28*c* on bracket 44 by using the hole mounts 44*a*.

By providing holders 28*a*, 28*b* in a cantilevered manner, that is in a generally level configuration as can best be seen in FIG. 3, yarn packages 16*a*, 16*b* are maintained generally level and the sloughing off of yarn is prevented. Likewise, lower yarn package holders 28*c*, 28*d* are inclined upwardly as are yarn packages 16*c*, 16*d* so that sloughing off of yarn is likewise prevented. Yarn packages of up to 14" in diameter may be accommodated in each creel unit. In the arrangement as shown, the adjustability provides for accommodation of up to four yarn packages for supplying a single associated textile apparatus such as an accumulator or loom, in a minimum amount of vertical space. It is to be understood, the yarn creel A may be used to feed yarn to one or more yarn accumulators 12 and then to a loom or other textile machine, or it may be used to feed yarn directly to a loom or other textile machine. The term "textile machine" as used herein means a yarn accumulator, a loom, or any other machine or device to which yarn or other similar or suitable strand material may be fed.

While a preferred embodiment of the invention has been described using specific terms, such description is for illustrative purposes only, and it is to be understood that changes and variations may be made without departing from the spirit or scope of the following claims.

What is claimed is:

1. A yarn creel for feeding yarn to an associated textile machine in a generally in-line yarn delivery path comprising:

an upstanding creel having a front frame and a rear frame;

a first pair of yarn package holders carried by said rear frame in a laterally spaced relation;

a second pair of yarn package holders carried by said rear frame in a laterally spaced relation, and said second pair of yarn package holders being vertically spaced from said first pair of yarn package holders;

a yarn eyelet carried by said front frame;

said first pair of yarn package holders being disposed so that yarn packages mounted on said yarn package holders have a center line which extends along a substantially horizontal plane towards said yarn eyelet; and said second pair of yarn package holders being disposed in an upwardly inclined position so that yarn packages mounted on said yarn package holders have a center line which extends upwardly towards said yarn eyelet; whereby said first and second pairs of yarn package holders are positioned to mount four yarn packages tailed together to feed yarn sequentially along at least two linear planes through said yarn eyelet and on to a single associated textile machine with a minimum of bends in said yarn delivery path.

2. The apparatus of claim 1 wherein:

said first and second pairs of yarn holders are carried by said rear frame in a vertical plane, and said yarn eyelet is carried by said front frame; and including adjustable frame elements connected between said front and rear frames allowing a horizontal spacing between said yarn eyelet and yarn package holders to be adjusted to provide for adjustable tensioning of yarn being fed from yarn packages mounted on said yarn package holders.

3. The apparatus of claim 2 wherein said front frame of said creel comprises a pair of vertical frame elements having a space there between; and said yarn eyelet being carried by said vertical frame elements so that yarn passes through said eyelet between said vertically frame elements.

4. The apparatus of claim 2 wherein said adjustable frame elements comprises a first telescoping frame element carried near a bottom of said creel, and an upper telescoping frame element carried near an upper portion of said creel; and said upper and lower frame elements comprising telescoping legs and a lock which locks said telescoping legs in a desired position wherein said front and rear frame sections may be spaced at selected desired distances apart.

5. The apparatus of claim 1 wherein:

said first pair of yarn package holders includes first and second yarn package holders, said second pair of yarn package holders include third and fourth yarn package holders, and including lower adjustable mounts for carrying said third and fourth yarn package holders; and said lower adjustable mounts including an angled bracket having a plurality of mounting holes for adjustably mounting said third and fourth yarn package holders along a length of said angled bracket in an inclined configuration.

6. The apparatus of claim 5 including fifth and sixth yarn package holders carried by said lower adjustable mounts in a generally level configuration and spaced oppositely to said inclined, third and fourth yarn package holders relative to said second frame.

7. The apparatus of claim 1 including adjustable mounts for mounting said first and second pair of yarn package holders to said rear frame;

said adjustable mounts providing for adjusting the vertical position of said yarn package holders relative to each other on said rear frame for positioning said four yarn packages in a minimum of vertical space.

8. The apparatus of claim 7 including a third pair of yarn package holders mounted generally behind said second pair of yarn package holders; and said third pair of yarn package holders being carried by said adjustable mounts in a generally cantilevered manner wherein said third pair of yarn package holders are generally level, said third pair of yarn package holders being interchangeable in a feeding position with said second pair of yarn package holders; whereby said creel may be converted for tailing of two associated yarn packages rather than four associated yarn packages.

9. The apparatus of claim 8 including a second yarn eyelet for receiving yarn from said third pair of yarn package holders.

10. A yarn creel comprising at least two creel units for feeding yarn to an associated textile machine in a generally in-line yarn delivery path comprising:

each said creel unit having a front frame and a rear frame;

each said creel unit comprising:

a yarn eyelet carried by said front frame;

a first pair of yarn package holders carried by said rear frame in a laterally spaced relation so that yarn packages mounted on said yarn package holders have a center line which extends along a first plane towards said yarn eyelet;

a second pair of yarn package holders carried by said rear frame in a laterally spaced relation, said second pair of yarn package holders being vertically spaced from said first pair of yarn package holders;

said second pair of yarn package holders being inclined upward so that yarn packages mounted on said yarn package holders have a center line which extends along a second plane towards said yarn eyelet;

adjustable mounts for mounting said first and second pair of yarn package holders to said rear frame;

said adjustable mounts providing for adjusting the vertical position of said yarn package holders relative to each other on said frame for positioning said four yarn packages in a minimum of vertical space; and said first and second pairs of yarn package holders being positioned and arranged to mount four yarn packages tailed together to feed yarn along one of said planes to said yarn eyelet and onto an associated textile machine in a generally straight yarn delivery path.

11. The apparatus of claim 10 wherein:

said first and second pairs of yarn holders are carried by said rear frame in a vertical plane, and said yarn eyelet is carried by said front frame; and including adjustable frame elements connected between said front and rear frames allowing said yarn eyelet and yarn package holders to be adjusted with respect to their horizontal spacing to provide for adjustable tensioning of yarn being fed from yarn packages mounted on said yarn package holders.

12. The apparatus of claim 11 wherein said adjustable frame elements comprises a first telescoping frame element carried near a bottom of said creel frame, and an upper telescoping frame element carried near an upper portion of said creel frame.

13. The apparatus of claim 12 wherein said upper and lower frame elements comprising telescoping legs and a lock which locks said telescoping legs in a desired position wherein said front and rear frame sections are spaced a desired distance apart.

14. The apparatus of claim 10 wherein said first pair of yarn package holders includes first and second yarn package holders, said second pair of yarn package holders include third and fourth yarn package holders which are upwardly inclined, and including:

lower adjustable mounts for carrying said third and fourth yarn package holders; and fifth and sixth yarn package holders carried by said lower adjustable mounts in a generally level configuration and spaced oppositely from said inclined, third and fourth yarn package holders relative said second frame.

15. The apparatus of claim 14 including a second yarn eyelet for receiving yarn from said third pair of yarn package holders.

16. The apparatus of claim 10 when said creel units are vertically stacked.

17. A method for feeding weft yarn to an associated textile machine in a yarn delivery path which is generally in-line with said associated textile machine comprising:

mounting a first pair of yarn packages consisting of a first yarn package and a second yarn package in a horizontally spaced apart manner;

arranging said first and second yarn packages so that center lines of said yarn packages extend a distance through a yarn eyelet and along a substantially horizontal plane;

mounting a second pair of yarn packages consisting of third and fourth yarn packages vertically below said first and second yarn packages;

mounting said third and fourth yarn packages at an inclination so that center lines of said third and fourth yarn packages extend said distance to said yarn eyelet; and securing tail ends of certain ones of said yarn packages together so that yarn delivered through said yarn eyelet is supplied sequentially from said yarn packages to said associated textile machine.

18. The method of claim 17 including adjusting said distance between said yarn packages and said eyelet to provide a desired tension to said yarn being delivered off of said yarn packages.

19. The method of claim 17 including providing mounts for said third and fourth yarn packages which include both an upwardly inclined yarn package holder and a generally level yarn package holder and selecting between said inclined or level yarn package holder depending on whether four yarn packages are to be supplied together, or two yarn packages are to be supplied together, and providing an additional yarn eyelet when said creel is converted to supplying two yarn packages together.

* * * * *